US008151703B2

(12) United States Patent
Schweizer et al.

(10) Patent No.: US 8,151,703 B2
(45) Date of Patent: Apr. 10, 2012

(54) ELECTRICALLY OPERATED PRESS TOOL APPARATUS

(75) Inventors: Beat Schweizer, Titterten (CH); Martin Moritz, Landser (FR)

(73) Assignee: Von Arx AG, Sissach (CH)

( * ) Notice: Subject to any disclaimer, the term of this patent is extended or adjusted under 35 U.S.C. 154(b) by 273 days.

(21) Appl. No.: 12/456,242

(22) Filed: Jun. 12, 2009

(65) Prior Publication Data

US 2010/0000425 A1 Jan. 7, 2010

(30) Foreign Application Priority Data

Jun. 18, 2008 (CH) ..... 942/08

(51) Int. Cl.
*B30B 1/32* (2006.01)
*B21J 15/20* (2006.01)

(52) U.S. Cl. ..... 100/269.15; 72/453.15; 72/453.16; 60/477

(58) Field of Classification Search ..... 100/269.01, 100/269.05, 269.14, 269.15, 269.17; 72/453.15, 72/453.16, 453.17; 60/477, 478, 485
See application file for complete search history.

(56) References Cited

U.S. PATENT DOCUMENTS

| | | | | |
|---|---|---|---|---|
| 5,125,324 | A * | 6/1992 | Araki et al. | 91/454 |
| 6,510,723 | B2 * | 1/2003 | Amherd | 72/453.16 |
| 7,254,982 | B2 * | 8/2007 | Frenken | 72/453.15 |
| 7,412,868 | B2 * | 8/2008 | Frenken | 72/453.15 |
| 2007/0271992 | A1 * | 11/2007 | Amherd | 72/453.19 |

FOREIGN PATENT DOCUMENTS

| | | |
|---|---|---|
| DE | 10 2007 005 837 A1 | 8/2007 |
| EP | 1 689 563 B1 | 8/2006 |

* cited by examiner

*Primary Examiner* — Jimmy T Nguyen
(74) *Attorney, Agent, or Firm* — Pauley Petersen & Erickson

(57) ABSTRACT

A pump receiver housing of a hydraulically operated pressing apparatus designed in a compact and lightweight manner and that connects a drive unit to a piston cylinder unit and to a press unit. A piston pump assembly is connected to a pump flange pressed directly onto a connection cylinder of the piston-cylinder unit. The connection cylinder projects through a pump lead-through in the housing wall into the pump receiver housing, and directly contacts on the pump piston. Thus, the pump receiver housing is designed without conduits, so that an inside of the pump receiver housing is free of or has no high pressure.

8 Claims, 7 Drawing Sheets

ELECTRICALLY OPERATED PRESS TOOL APPARATUS

BACKGROUND OF THE INVENTION

1. Field of the Invention

This invention describes an electrically operated press tool apparatus with a hydraulic pump driven by a drive unit and which acts on a hydraulic piston cylinder unit actively connected to a roller holder, with rollers that roll on clamping jaws of a clamping pincer and thus move these relative to one another, and the press tool apparatus, apart from a pump receiver housing with a housing wall and a housing cover, includes an actuation valve for opening the passage between the pump receiver housing and the piston-cylinder unit.

2. Discussion of Related Art

Electrically operated press tool apparatus have been known for some years. Portable, hydraulically impinged press tool apparatus of the above mentioned type are applied for pressing coupling elements, such as press sleeves, press fittings, pipe muffs, tube sections pushed into one another, and likewise.

The press tools include a press unit with a clamping pincer having clamping jaws, which form a press space for receiving the coupling element to be pressed. The press pressure which is required for the pressing is provided by a hydraulic unit.

Each apparatus obtainable on the market until now, is relatively large and accordingly heavy. Reductions in the construction size have previously failed because of demands dictated the constructional shape. Changes in the size of the press pincer would limit its field of application, and accordingly the press pincer may not be knowingly reduced in size. The respective roller holder must be adapted in size to the press pincer and this also applies to the fork-like receiver, in which the press pincer is held, and which is usually manufactured as one piece with a subsequent piston-cylinder unit. The size of the cylinder housing is practically dependent on the forces to be applied, and these forces thus depend on the size of the clamping pincer.

A hydraulic unit is arranged after the piston-cylinder unit, and includes a hydraulic pump in a pump receiver housing. Hydraulic fluid, generally hydraulic oil, is pumped through high-pressure conduits from a fluid reservoir and/or from the pump receiver housing, into the hydraulic pump and from the hydraulic pump into the piston-cylinder unit. Thus, the piston is displaced in the actuation direction and the clamping pincer is closed. If such a clamping procedure is finished, then with many apparatus types, the hydraulic oil is pumped back into the hydraulic container and with some devices of this type, a direct return from the flow conduit to a return conduit or suction conduit is effected via a suitable actuation valve. The mentioned functions require a construction as described. Accordingly, a miniaturization without a loss of power is practically not possible. A reduction in size of the press pincer apparatus may only be achieved with innovative measures as a result.

In order to achieve a weight reduction of the hand-operated press tool apparatus, one has increasingly applied piston pumps, which apart from a weight saving, also achieve greater fluid pressures than gear pumps and thus may provide greater powers. The weight saving which may be achieved does not yet lead to the desired results, and the increase in the occurring fluid pressure caused new difficulties for the known press tool apparatus.

High-pressure conduits are applied within the pump receiver housing or apparatus housing of the press tools according to the state of the art, which connect the pump receiver housing, the hydraulic pump and the piston-cylinder unit to one another. German Patent Reference DE102007005837 describes a hydraulic unit of a linearly designed press tool apparatus, which is limited by an elastic wall or a flexible hose and sealingly surrounds the region of the piston pump and of a control valve. The hydraulic fluid is held in a hydraulic fluid circuit by the hydraulic fluid being led back through channels leading into a hydraulic fluid reservoir.

These high pressure conduits must seal at fluid pressures of a few hundred bars, which is often a problem. Suitable high-pressure conduits are practically only manufacturable of metal, in order to achieve the desired stability. In order to securely mount these high-pressure conduits, the pump receiver housing can be designed in a metallic manner, and the high-pressure conduits are fixed on or in the pump receiver housing. With the arrangement of the high-pressure conduits, the known pump receiver housing is often designed with a great volume in order to accommodate the components within the pump receiver housing.

SUMMARY OF THE INVENTION

It is one object of this invention to provide a weight reduction of an electrically operated press tool apparatus, by an optimization of the construction manner of the hydraulic unit.

This object and the simplified assembly, as well as the attainment of greater serviceable lives due to reduced leakage and loss of hydraulic fluid, is achieved by a device with the features described in this specification and in the claims.

BRIEF DESCRIPTION OF THE DRAWINGS

A preferred embodiment as an example of the subject-matter of this invention is described in view of the accompanying drawings, wherein.

DETAILED DESCRIPTION OF THE INVENTION

Figure 1:
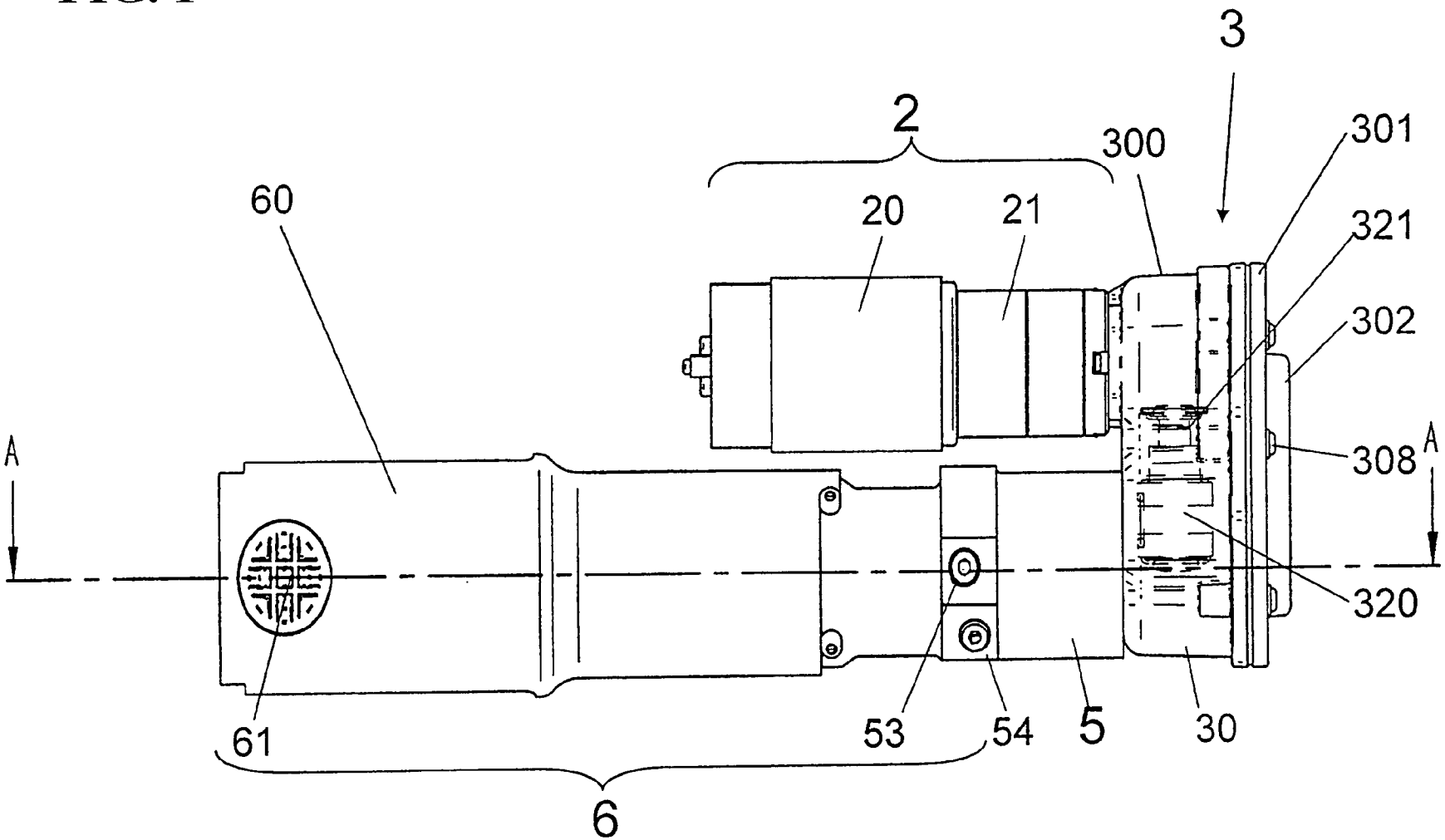
FIG. 1 shows a front view of a drive unit, a hydraulic unit, a piston-cylinder unit and a press unit of a press tool apparatus designed in the manner of a pistol, with a removed apparatus housing.
Figure 2:
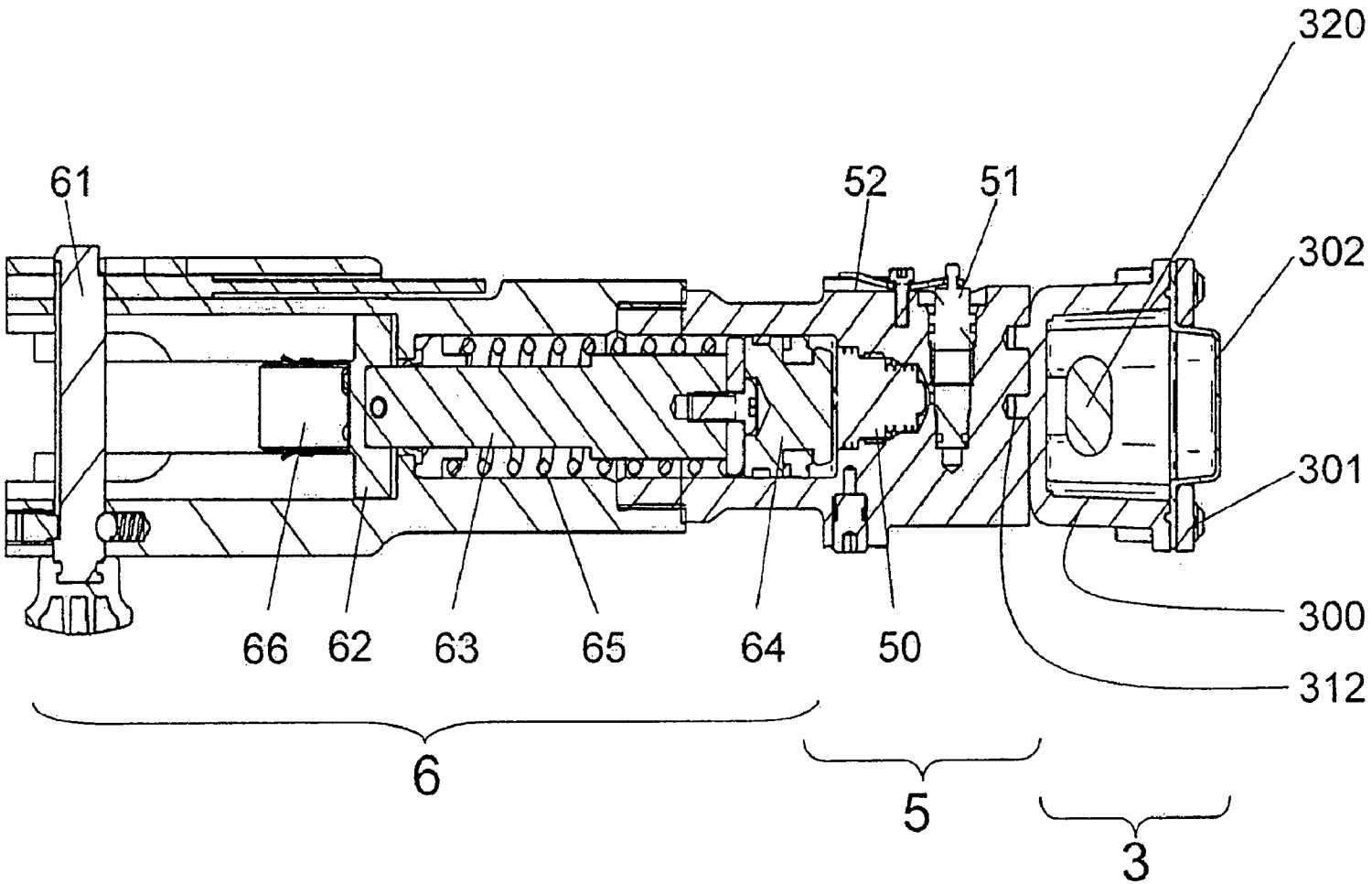
FIG. 2 shows a longitudinal section taken through the press unit, the piston cylinder unit and the hydraulic unit along the section line A-A of FIG. 1.
Figure 3:
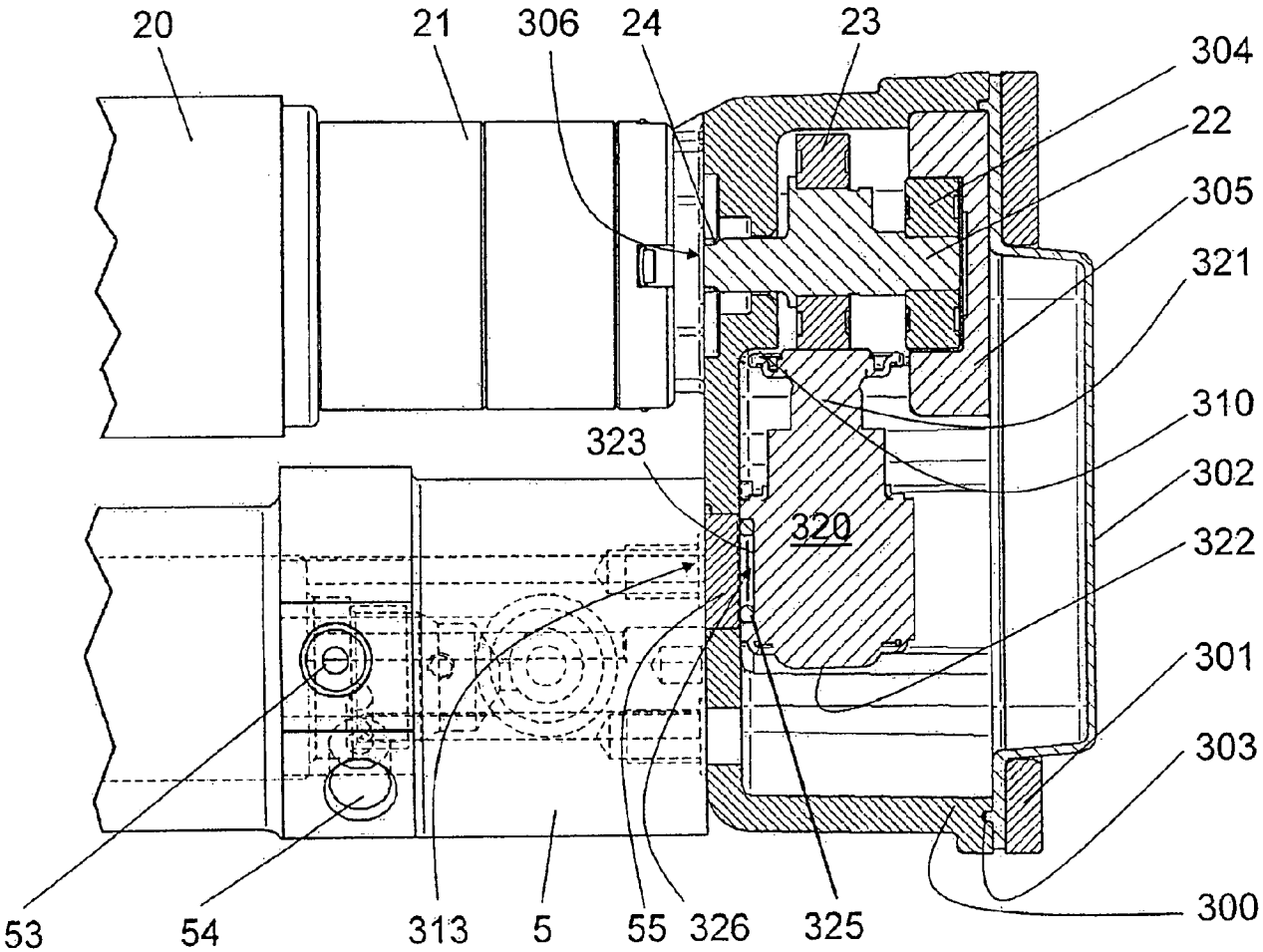
FIG. 3 shows the hydraulic unit according to this invention in a detailed manner, wherein the pump receiver housing is represented in a partial sectioned manner.
Figure 4:
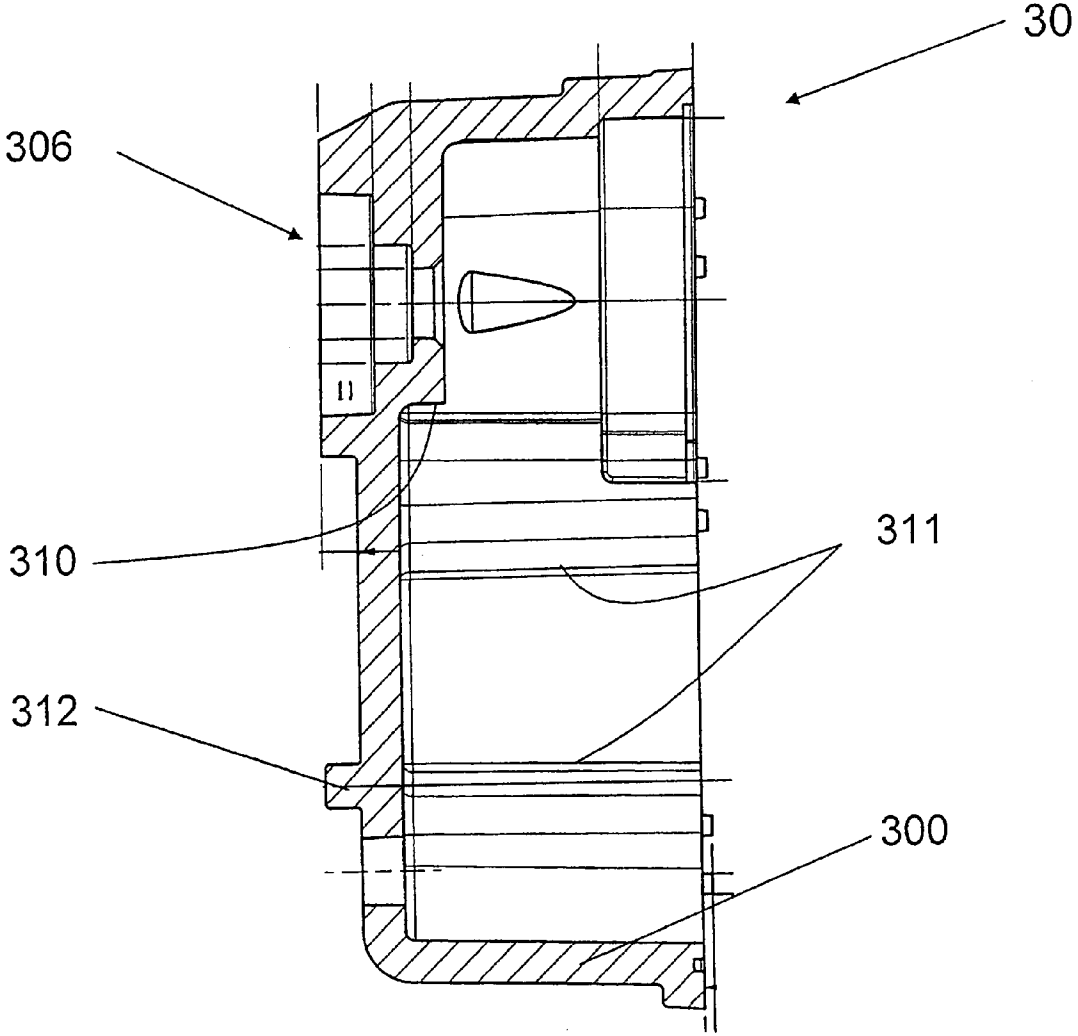
FIG. 4 shows a longitudinal section taken through the pump receiver housing.
Figure 5:
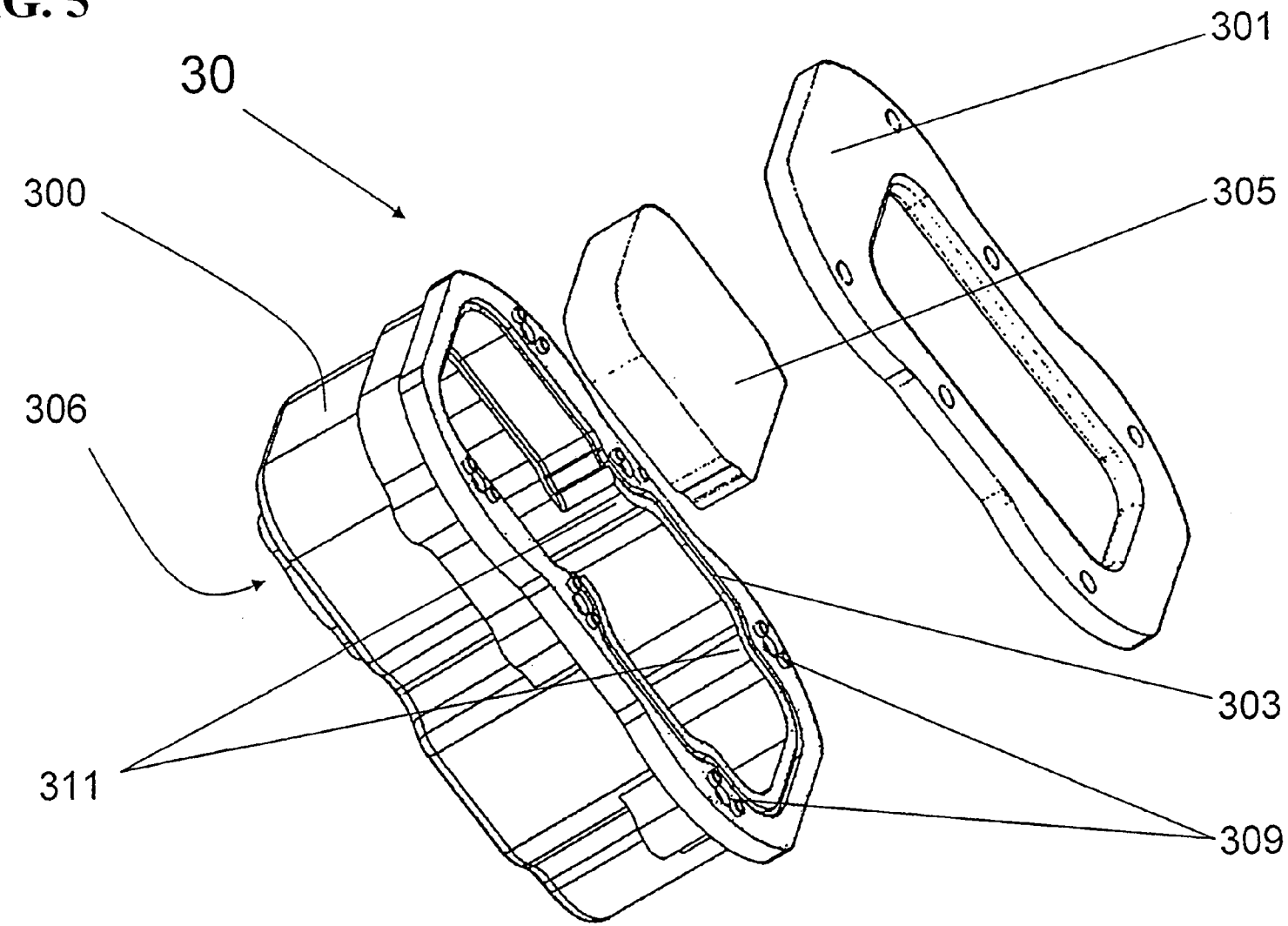
FIG. 5 shows a perspective exploded representation of the pump receiver housing, having the housing wall, an eccentric shaft bearing and a housing cover.
Figure 6:
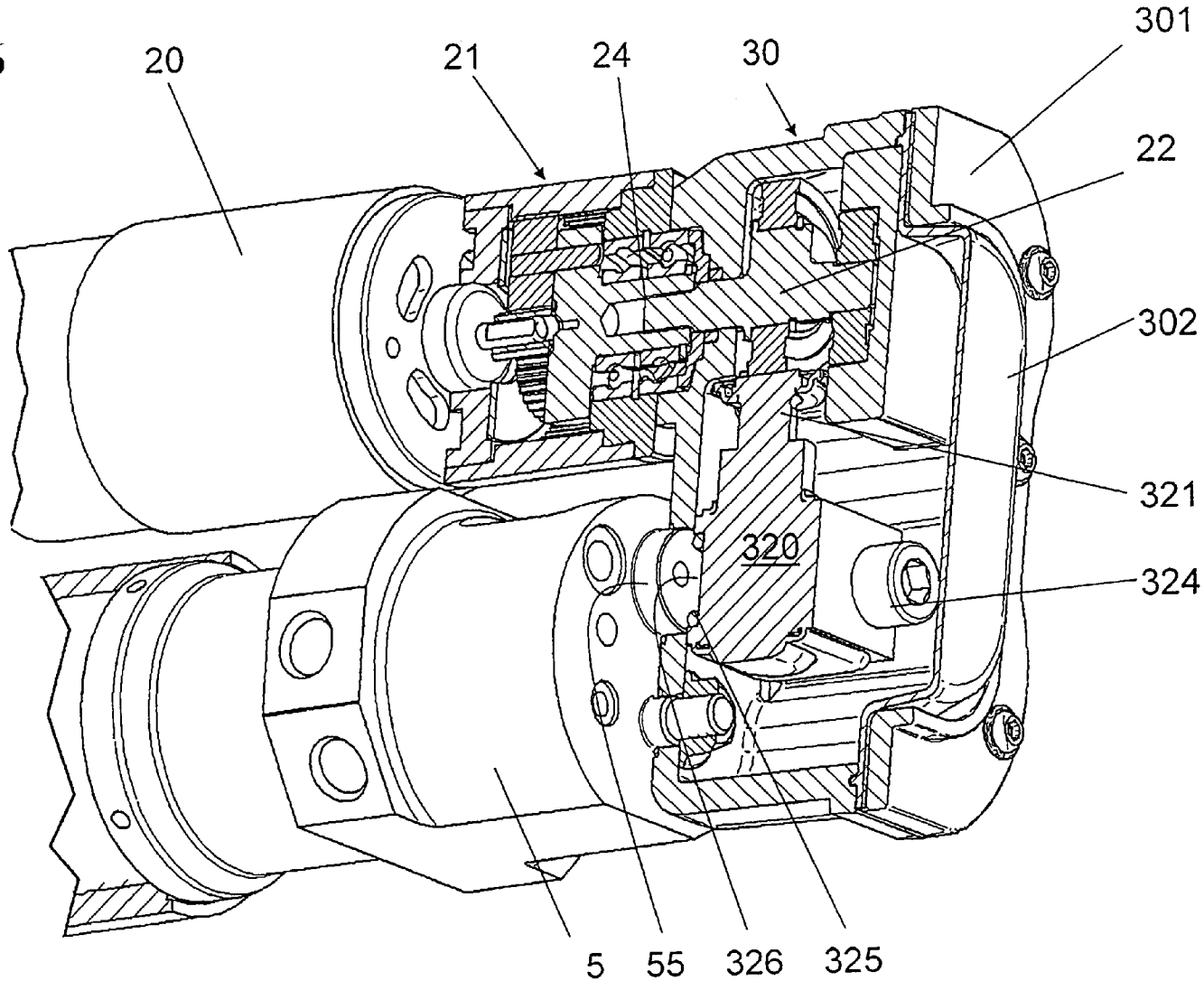
FIG. 6 shows a partly sectioned perspective view of the pump receiver housing and of the gear of the drive unit.
Figure 7:
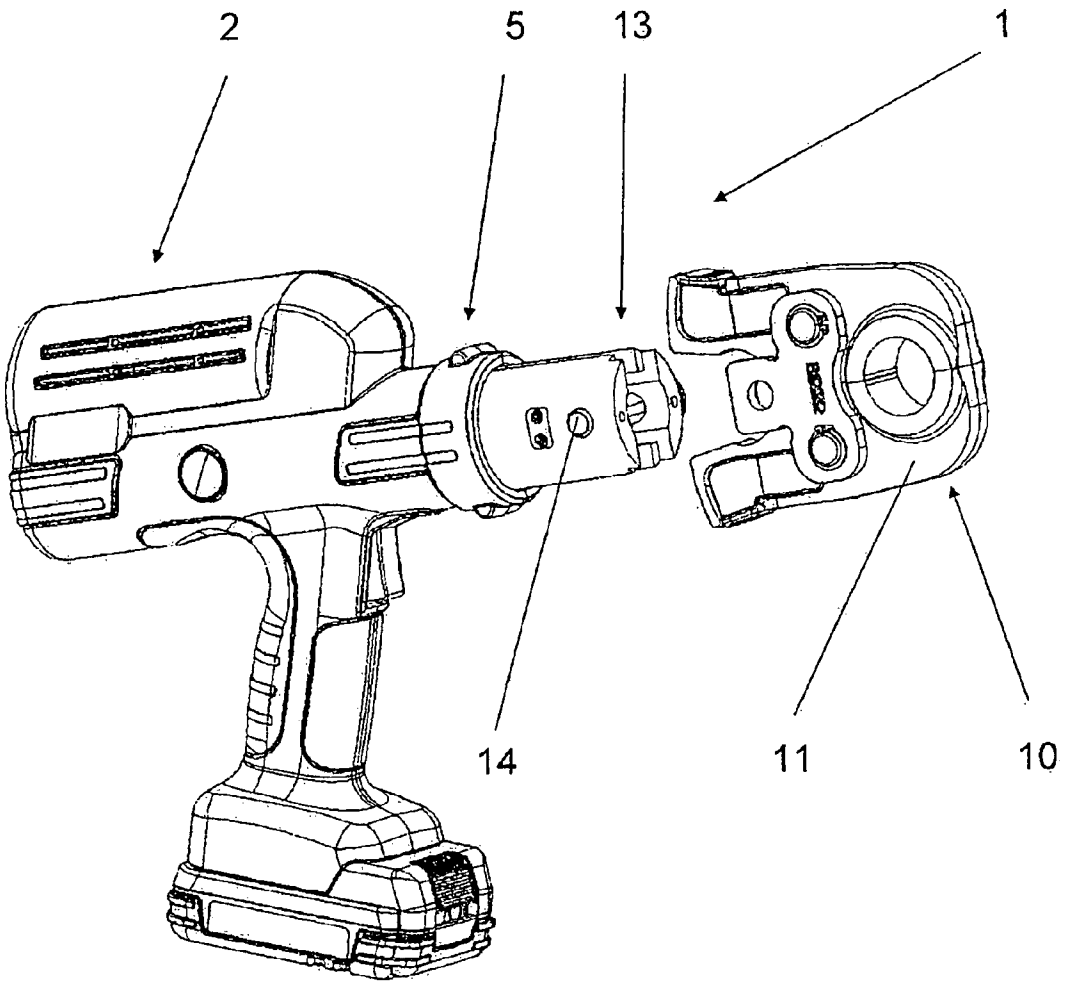
FIG. 7 shows a perspective view of a complete press tool apparatus.

One embodiment of a press tool apparatus 1 according to the state of the art is shown in FIG. 7.

The actual functional part is packaged in an apparatus housing of plastic. Also, one recognizes the clamping pincer 10, which has two clamping jaws 11 and is held via a secured bolt 14 in a fork-like receiver 13. Rollers 66 which are rotatably mounted in a roller holder 62, are located in the fork-like receiver 13. The rollers 66 are pushed forwards by a piston-cylinder unit 5, wherein the clamping jaws 11 close. The clamping jaws 11 are shown in the closed condition in FIG. 7.

With a removed apparatus housing, one may recognize that the electrically operated press tool apparatus 1 comprises a drive unit 2, a hydraulic unit 3, a piston-cylinder unit 5 and a press unit 6. The preferred embodiment of the pressing apparatus which is represented in the subsequent figures, is designed in a pistol-like manner, wherein a linear design according to the state of the art is also possible.

The hydraulic unit 3 connects the drive unit 2 and the piston cylinder unit 5, wherein the longitudinal axis of the drive unit 2 and the longitudinal axis of the press unit 6 lie approximately parallel to one another. An electronic control device as well as an electronic display device is omitted in the figures, for the sake of simplification. The electronic control device serves for activating and for carrying out the pressing procedures, wherein a piston 64 is linearly advanced by a fluid pressure of a few hundred bar which is built up in the hydraulic unit 3. The electronic display device, for example, indicates whether the pressing procedure is desired and how many pressuring procedures have been carried out until present.

A piston rod 63 which is mounted in a spring 65, is moved linearly in the direction of the fork-like receiver 13 of the press unit 6 by the linear advance of the piston 64. The roller holder 62 which is fastened on the piston rod 63, closes the clamping jaws 11 given a linear advance of the piston 64, wherein a pipe fitting may be fastened onto at least one pipe. The clamping jaws 11 are held by the bolt 61. The correct seat of the clamping jaws 11 is read out by the electronic control device and is represented by the electronic display device.

The drive unit 2 comprises an alternating current and direct current electric motor 20 which comprises a motor shaft which is led into a gear assembly 21, in this embodiment example, into a planetary gear assembly 21. The gear assembly 21 comprises a hollow shaft 24, into which an eccentric shaft 22 may be introduced and is held mounted with a positive fit in the hollow shaft 24. The rotation movement of the hollow shaft 24 which is geared by the gear assembly 21 is transmitted onto the eccentric shaft 22. The connection between the hollow shaft 24 and the eccentric shaft 22 is located in the region of or near a gear flange 306 on a pump receiver housing 30 of the hydraulic unit 3.

The hydraulic unit 3 comprises a piston pump assembly 320 and is enclosed and sealed by the pump receiver housing 30, wherein the pump receiver housing 30 comprises a housing wall 300, a housing cover 301 and a flexible, rubber-elastic housing wall 302 of an elastomer.

The eccentric shaft 22, crossing the housing wall 300, is led into the pump receiver housing 30, wherein a rotating sealing ring which is not shown, prevents a hydraulic fluid located in the pump receiver housing 30 from running out. The fastening of the drive unit 2 on the pump receiver housing 30 is ensured by the plug connection between the hollow shaft 24 and the eccentric shaft 22, wherein the plug connection may be secured from inadvertent release by securing means, which are not shown.

An eccentric shaft bearing 304 on the eccentric shaft 22 is located opposite the gear flange 306, and is connected to the eccentric shaft 22 with a non-positive fit or with a positive fit, wherein the eccentric shaft bearing 304 is rotatably mounted in a bearing block 305. The bearing block 305 is exchangeably held in a recess in a housing wall 300. The eccentric shaft 22 is linearly movable in the direction of the rotation axis with only little play and is thus movable essentially in a rotational manner. The bearing block 305 is applied into a recess in the pump receiver housing 30 and is fixed by the housing cover 301. With this mounting of the eccentric shaft 22, only small bending moments are transmitted onto the housing wall 300 of the pump receiver housing 30 and thus only small forces act on the pump receiver housing 30. The housing wall 300 may be provided with reinforcement ribs 311, by which bending moments are further reduced.

An eccentric disk 23 is unreleasably connected to the eccentric shaft 22 with a non-positive and/or positive fit, so that the eccentric disk 23 is led along with the rotating movement of the eccentric disk 22. A piston pump assembly 320, whose movable pump piston 321 is actively connected to the eccentric disk 23, is located completely within the pump receiver housing 30. By rotation of the eccentric shaft 22 driven by the motor 20 via the gear assembly 21, of several thousand r.p.m, the pump piston 321 is linearly displaced just as often. With each travel of the pump piston 321, hydraulic fluid is sucked through an inlet valve 322 and through an exit valve 323 in a pump flange, into the piston cylinder unit 5, by which a higher fluid pressure of a few hundred bars is built up.

As soon as the fluid pressure reaches a defined value, an actuation valve 50 is opened, by which the piston 64 is linearly displaced, subsequently to which the pump procedure may begin again with a closed actuation valve 50.

The piston pump assembly 320 is arranged completely within the pump receiver housing 30, partly crossing the pump receiver housing 30. A piston abutment 310 may be integrally formed on the housing wall 300, by which a stable mounting of the piston pump 320 is encouraged.

At least one pump fastener or fastening means 324 fixes the piston pump 320 in the inside of the pump receiver housing 30 to the housing wall 300 in a releasable or unreleasable manner. A pump flange 326 and the exit valve 323 point in the direction of the piston-cylinder unit 5. The piston-cylinder unit 5 has a connection cylinder 55, which is arranged crossing a pump lead-through 313 of the pump receiver housing 30 and projecting through the housing wall 300. The pump flange 326 of the piston pump assembly 320, in direct contact with the connection cylinder 55, is mounted by being pressed onto the piston cylinder unit 5. An O-ring 325 in the region of or near the exit valve 323 seals the inside of the pump receiver housing 30 to the piston cylinder unit 5.

The housing wall 300 is stuck on the piston cylinder unit 5 in a predefined position with an integrally formed centring pin 312 and is fastened with a positive fit and/or non-positive fit to the pump fastening means 324 which for example is inserted through a housing fastening bore 309.

The flexible housing wall 302 is applied onto the edge of the housing wall 300, which comprises a peripheral sealing groove 303. A fluid-sealing fixation of the pump receiver housing 30 is achieved by the fixation of the housing cover 301 to at least one cover fastener or fastening means 308 in at least one cover bore, wherein a section of the flexible housing wall 302 engages into the sealing groove 303.

The pump receiver housing 30 according to this invention remains free from high pressure because of the direct fastening of the piston pump 320 on the piston cylinder pump unit 5, which is presented here. No high-pressure conduits are located in the inside of the pump receiver housing 30, which is why it is designed free of conduits. The pump receiver housing 30 is filled with hydraulic fluid, wherein the fluid pressure within the pump receiver housing 30 is very small and pressure oscillations only with low pressure fluctuations occur on account of the periodic deflections of the pump piston 321.

By an almost free rotation of the eccentric shaft 22 mounted in the bearing block 305, only negligibly low bending moments engaging on the housing wall 300 occur. These bending moments do not close the pump receiver housing 30 and they do not lead to leaks, by which the serviceable lives of the pressing apparatus are increased.

The piston cylinder unit 5 comprises a fluid inlet 53 and a fluid outlet 54, which are both easily accessible and permit a simple level correction of the hydraulic fluid. If a pressing has not been carried out in a complete manner and thus the fluid pressure is not partly or completely let off by the actuation valve 50, then one may actuate an emergency stop valve 51 with an emergency stop lever 52, by which the excess pressure may be let off.

The pump receiver housing 30 is filled with hydraulic fluid up to the lower edge of the housing cover 301. After assembly of all components, excess air is pumped away from the pump receiver housing 30. A formation of bubbles is thus prevented by sucking-away of air, by which the pump process is optimized.

Because of the design, the moving parts are arranged within the pump receiver housing 30 so that almost no forces act on the housing wall 300 and the housing cover 301, and thus a negligible bending stress in the housing wall 300 results. Thus, it is possible to manufacture the housing wall 300 and the housing cover 301 of a thermoplastic with the injection molding method. It is advantageous that the housing walls 300 and the housing cover 301 manufactured in the injection molding do not need to be subsequently machined or processed, which reduces the manufacturing time and the manufacturing costs. In order to even further increase the duration strength of the pump receiver housing 30, it is advantageous to integrally form reinforcement ribs 311 into the housing wall 300.

In comparison to the pump receiver housings manufactured from metal according to the state of the art, one may also save weight on account of the use of thermoplasts, for example polyamide with a glass fiber reinforcement, which is of interest for a hand-operated pressing apparatus. After the injection molding and the cooling, the pump receiver housing 30 may be installed directly for limiting the hydraulic unit 3 and for receiving the piston pump assembly 320.

Trials with a housing wall 300 of duroplast have led to a destruction of the housing wall 300, since the rigid duroplast does not withstand the vibrations which originate from the eccentric disk 23 and the pump piston 321.

The pump receiver housing may be designed to be adapted to volume, by covering the pump receiver housing 30 with the rubber-elastic housing wall 302. According to the state of the art, a separate element is applied for the volume adaptation, which in turn requires additional conduits and additional space. A system is known from European Patent Reference EP 1689563, with which the hydraulic oil receptacle is formed by a rubber-elastic sleeve around the piston cylinder unit. Here, separate hydraulic conduits would be necessary for such a design, which are undesirable.

A maintenance of the hydraulic unit 3, for example an exchange of the piston pump assembly 320, is possible in a simple manner by the at least one cover fastening means 308 being released and the housing cover 301 together with the flexible housing wall 302 of an elastomer being removed, after letting off of the hydraulic fluid out of the fluid run-off 54. The piston pump assembly 320 is subsequently removed by removal of the pump fastening means 324, and may be replaced.

Swiss Patent Reference CH-00942/08, filed 18 Jun. 2008, the priority document corresponding to this invention, to which a foreign priority benefit is claimed under Title 35, United States Code, Section 119, and its entire teachings are incorporated, by reference, into this specification.

What is claimed is:

1. An electrically operated press tool apparatus (1) with a hydraulic pump assembly (320) driven by a drive unit (2) and which acts on a hydraulic piston cylinder unit (5) actively connected to a roller holder (62), with rollers (66) that roll on clamping jaws (11) of a clamping pincer (10) and move these relative to one another, and the press tool apparatus (1), apart from a pump receiver housing (30) with a housing wall (300) and a housing cover (301), comprises an actuation valve (50) for opening a passage between the pump receiver housing (30) and the piston-cylinder unit (5), the electrically operated tool apparatus comprising:

the pump receiver housing (30) having no conduits, and a pump flange (326) with an outlet valve (323) of the hydraulic pump assembly (320) fixed in a pressing manner directly onto a connection cylinder (55) of the piston cylinder unit (5) so only pressure oscillations with a low fluid pressure occur within the pump receiver housing (30).

2. The electrically operated press tool apparatus (1) according to claim 1, wherein at least one pump fastener (324), releasably or non-releasably, connects the piston pump assembly (320) to the pump flange (326) on the connection cylinder (55) within the pump receiver housing (30), in a pressing and direct manner, so that the inside of the pump receiver housing (30) is free of high pressure.

3. The electrically operated press tool apparatus (1) according to claim 1, wherein the connection cylinder (55) crosses a pump lead-through (313) in the housing wall (300) of the pump receiver housing (30).

4. The electrically operated press tool apparatus (1) according to claim 1, wherein the housing wall (300) is of a thermoplast.

5. The electrically operated press tool apparatus (1) according to claim 4, wherein the housing wall (300) is manufactured of a polyamide with a glass fiber reinforcement.

6. The electrically operated press tool apparatus (1) according to claim 5, wherein the housing wall (300) has reinforcement ribs (311).

7. The electrically operated press tool apparatus (1) according to claim 1, wherein an eccentric shaft (22), drivable by the drive unit (2), is held in active connection with a pump piston (321) of the hydraulic pump assembly (320), rotatable in a bearing block (305) within the pump receiver housing (30).

8. The electrical operated press tool apparatus (1) according to claim 1, wherein the pump receiver housing (30) is covered with a rubber-elastic housing wall (302), so that the pump receiver housing (30) simultaneously forms a hydraulic oil receiver receptacle which may be adapted in volume.

* * * * *